US005570996A

United States Patent [19]

Smiley, III

[11] Patent Number: 5,570,996

[45] Date of Patent: Nov. 5, 1996

[54] COMPACT CENTRIFUGAL FAN

[75] Inventor: William A. Smiley, III, La Crosse, Wis.

[73] Assignee: American Standard Inc., Piscataway, N.J.

[21] Appl. No.: 266,905

[22] Filed: Jun. 27, 1994

[51] Int. Cl.[6] ..... F04D 29/44

[52] U.S. Cl. ..... 415/53.2; 415/204; 415/206; 415/208.1

[58] Field of Search ..... 415/53.2, 206, 415/204, 208.1, 211.1

[56] References Cited

U.S. PATENT DOCUMENTS

| | | | |
|---|---|---|---|
| 801,304 | 10/1905 | Davidson | 415/204 |
| 820,398 | 5/1906 | Davidson | 415/204 |
| 820,399 | 5/1906 | Davidson | 415/204 |
| 2,290,423 | 7/1942 | Funk | 415/206 |
| 3,491,550 | 1/1970 | Cavis . | |
| 3,796,511 | 3/1974 | Hansen . | |
| 4,135,850 | 1/1979 | d'Anjou . | |
| 4,253,796 | 3/1981 | Philipps et al. . | |
| 4,411,453 | 10/1983 | Philipps et al. . | |
| 4,549,848 | 10/1985 | Wallman | 415/206 |
| 4,553,404 | 11/1985 | Malchow et al. . | |
| 4,573,869 | 3/1986 | Kitamoto . | |
| 4,680,006 | 7/1987 | Fisher . | |

FOREIGN PATENT DOCUMENTS

| | | | |
|---|---|---|---|
| 1808829 | 6/1970 | Germany | 415/204 |
| 2441988 | 3/1975 | Germany | 415/206 |
| 2633781 | 2/1978 | Germany | 415/206 |
| 3238913 | 4/1984 | Germany | 415/204 |
| 162299 | 12/1981 | Japan | 415/208.1 |
| 196997 | 11/1984 | Japan | 415/53.2 |
| 61-138900 | 6/1986 | Japan | 415/206 |
| 229999 | 10/1986 | Japan | 415/204 |
| 131899 | 6/1988 | Japan | 415/53.2 |
| 1687894 | 10/1991 | U.S.S.R. | 415/204 |

*Primary Examiner*—Edward K. Look
*Assistant Examiner*—James A. Larson
*Attorney, Agent, or Firm*—William J. Beres; William O'Driscoll; Peter D. Ferguson

[57] ABSTRACT

A centrifugal fan includes a housing that defines an air inlet leading to an air chamber defined within the fan impeller and an air exit port coupled to an air passageway. The housing includes a shroud that defines a two zone air passageway in the housing. The first zone, commencing adjacent to the base of the exhaust port, is a conformal portion that is conformal to the exterior diameter of the centrifugal fan and spaced slightly apart therefrom. The second zone of the shroud is a scroll portion wherein the angle of expansion is capable of expanding between 10° and 15°. An air restrictor plate is supported inside the air chamber of the centrifugal fan. At the greatest width of the air restrictor plate, the air restrictor plate subtends an arc that is substantially coextensive with the arc subtended by the first conformal zone of the shroud. The restrictor prevents the flow of inlet air through the centrifugal fan in the region of the conformal shroud.

17 Claims, 5 Drawing Sheets

COMPACT CENTRIFUGAL FAN

TECHNICAL FIELD

The present invention relates to centrifugal fans. More particularly, the present invention relates to a centrifugal fan having a housing especially adapted to optimize air flow in a compact fan design.

BACKGROUND OF THE INVENTION

Centrifugal fans are utilized in a wide variety of applications where efficient movement of air is required. In the air conditioning industry, for instance, centrifugal fans provide the energy to move air that has been either cooled or heated by a heating, ventilation, and air conditioning (HVAC) system. The air is transported to the space to be heated or cooled through ducts or other apparatus that form the air delivery side of the HVAC system. In certain applications, the fans are integral with the various components of the HVAC system, as for example, in installations including the fan as part of a single fan coil unit along with coils, filters, air exchangers, and the like.

Centrifugal fans utilized in HVAC systems typically have a circular impeller having structure forming an inside diameter and an outside diameter with a plurality of radially directed blades disposed therebetween. The blades are curved forward in the direction of rotation at the heel of the blade and may be straight or curved slightly away from the direction of rotation at the tip of the blade. An air inlet chamber is defined within the inside diameter of the impeller. The impeller is typically mounted on a stub shaft which is in turn connected to an electric motor. The stub shaft may be an extension of the motor shaft or the motor may drive the impeller through a gear set or by means of a belt and pulleys.

The impeller is typically carried within a scroll-shaped housing. A shroud portion of the housing surrounds the impeller and expands in the radial dimension from a very small to a large cross sectional area, thereby defining the scroll shape. This expansion commences at the base or inner side of the exit port. As the shroud expands around the impeller in scroll fashion, the shroud ultimately forms the air exit port. The expanding scroll-shaped housing contributes substantially to the depth dimension of the fan and limits the applications in which such a fan may be employed. The air exit port has a relatively large cross-sectional area and is typically formed tangential to the circular impeller.

One side of the typical fan housing has a large central inlet opening that is usually circular. The central opening defines an air inlet into the center, interior air chamber of the impeller. In operation, the impeller draws air through the air inlet into the air chamber. The air is drawn into the inlet of the blades. The blades attack the air and accelerate the air in the radial direction. The accelerated air is discharged at relatively high velocity radially from the discharge portion of the impeller blades into the scroll-shaped housing that surrounds the impeller. The high velocity air travels through the air passageway defined by the scroll-shaped housing and is then discharged through the exit port to either heat or cool a space.

For optimum efficiency of the fan, the air passageway defined scroll shroud portion of the fan housing should have a 10° to 15° expansion commencing proximate the base of the exhaust port and expanding as the shroud wraps around the centrifugal fan until the scroll ultimately forms the exit port. This is required in order to efficiently accommodate the ever increasing volume of accelerated air that is forced into the air passageway by the fan. An additional parameter to be considered when designing for optimal performance of a centrifugal fan is the axial fan dimension, which defines the overall width of the fan. In particular, the width should be approximately 120% of the fan diameter. It is known that airflow capacity increases with fan width up to a width that is approximately 120% of fan diameter. With essentially a free inlet condition in which there are no impediments to the free flow of air into the air inlet, the range of design parameters indicated above provides optimal air output of a given centrifugal fan.

It has been noted, however, that the performance of a fan is degraded when less than free inlet conditions are encountered by a system having the above design parameters. A point of diminishing returns is reached where increases in fan width will not provide an increase in airflow, in fact, the airflow may actually decrease for widths too great. A specific application of the fan that results in a restricted airflow to the fan air inlet affects the maximum effective fan width.

More particularly, and as indicated above, centrifugal fans are often utilized to provide the air output from fan coil units. Fan coil units are typically relatively small units that can be utilized to either heat or cool a space. Accordingly, a basic fan coil unit contains a coil in which either hot or cold fluid is pumped, an air filter, and one or more centrifugal fans. A design goal of such units is to keep them relatively small. The small size of a fan coil unit makes such units attractive for remodeling or where existing building structure makes it difficult to install other types of units. The fan coil units are typically mounted on the floor, on a wall, or suspended from the ceiling of the space that is to be heated or cooled. Of particular interest in the design of such units is minimization of the depth dimension. The depth dimension defines the distance that the fan coil unit projects from the wall, ceiling, or other surface that the unit is mounted on. By minimizing the depth dimension, the fan coil unit may be installed in a relatively narrow opening and occupy the minimum possible volume in the space. Additionally, fan coil units typically have a relatively wide, slender air exhaust. In order to provide even air flow across such an air exhaust, many have between one and five fans arrayed side by side across the width of the air exhaust. Such fans may be driven on a common central shaft or two such fans may be mounted on either side of a drive motor having drive shafts projecting on either side thereof. The necessary plurality of fans adds to the complexity and cost of fan coil units.

Minimizing the depth of the fan coil unit has a direct impact on the centrifugal fan that is utilized within the unit. The centrifugal fan utilized within a fan coil unit is typically oriented such that the axial dimension of the centrifugal fan is parallel to the length dimension of the fan coil unit. This orientation means that the diameter of the fan and the fan housing is constrained by the depth dimension of the fan coil unit.

Additionally, the air inlet efficiency to the centrifugal fan is substantially affected by the depth dimension of the fan coil unit. The structure of the fan coil unit that includes the depth dimension effectively forms a duct through which any air entering the air inlet of the centrifugal fan must pass. The reduced size of the depth dimension forms an air flow restriction when compared to the optimal free inlet condition for which such fans should be designed. In the past, such air flow restrictions and dimension restrictions have required the redesign of the centrifugal fan housing to provide the best possible efficiencies. Such redesigns were a compromise, balancing air output with the limited depth dimension of the fan coil unit. Typically the redesigns resulted in only a 3° expansion of the scroll shroud and limited the axial dimension of the centrifugal fan to less than the diameter of the fan. Such minimal expansion does not provide the increasing area of the air passageway that is necessary to accommodate the full volume of air that is capable of being produced by an optimumly designed fan. The redesign reduces the air output of each individual fan, frequently requiring that additional fans be provided in a fan coil unit.

U.S. Pat. No. 3,796,511 discloses a centrifugal fan with a scroll housing that incorporates a dust-skimming slot at the outer periphery of the scroll housing approximate the exhaust port. To insure that air entering the air inlet did not pass directly through the fan and out the dust-skimming slot, a baffle was disposed on the interior side of the centrifugal fan in the vicinity of the dust-skimming slot to prevent such undesired air flow.

U.S. Pat. No. 4,573,869 discloses a centrifugal fan mounted within a relatively large plenum chamber. A first wind direction plate is mounted on the outer surface of the housing, and extends substantially to the center of the air inlet, to straighten the flow of air into the air inlet of the centrifugal fan housing. A second wind direction plate extends from the first plate through the air inlet into the fan along the axial and radial directions of the fan.

U.S. Pat. No. 4,680,006 discloses a centrifugal fan having a standardized production scroll housing. The design includes a radial wall barrier that extends into the air inlet to stabilize the outlet air flow from the fan. While each of the above mentioned patents deal with alterations of centrifugal fan housings to effect changes in fan air flow, none of the patents deal with the problem of optimizing air flow while reducing the depth dimension of a fan such that the fan may be utilized in a confined enclosure such as a fan coil unit.

A centrifugal fan that maximized air flow, while at the same time had the reduced fan depth necessary to accommodate a reduced depth dimension of a fan coil unit would provide decided advantages to the industry. Such an improved fan should include an impeller that is in the optimal range of 120% of the impeller diameter. A fan of such relatively greater width would permit reducing the total number of fans necessary to provide the airflow across the full width of the fan coil unit air exhaust and the expansion of the fan's scroll should remain between approximately 6 and 10 degrees, all within the confines of a compact design.

SUMMARY OF THE INVENTION

The present invention meets the objective of utilizing a high output centrifugal fan that is relatively wide and installed within a confined space, such as a fan coil unit, wherein the air entering the air inlet is restricted and where the diameter of the shroud portion of the housing is restricted. The high output is achieved by utilizing a fan width that is greater than the fan diameter. The scroll portion of the fan housing expands preferably at the desired 6° to 10°, although a range of between 5° to 12° may be utilized. The use of such fans permits reducing the total number of fans required for a given fan coil unit.

Airflow to the fan from the air inlet is effectively cutoff for a portion of the revolution of the fan, thus preserving the limited airflow for efficient acceleration by the fan throughout the remaining portion of the fan's revolution. To accomplish this, the present invention utilizes a unique centrifugal fan housing wherein the shroud portion of the housing is comprised of two zones. The first zone, adjacent to the base of the exhaust port, conforms to the exterior diameter of the centrifugal fan and is spaced slightly apart therefrom. The second zone of the shroud is a scroll portion wherein the angle of expansion is preferably capable of expanding between 6° and 10° within the space restrictions of the fan coil unit. The housing additionally includes an air restrictor plate mounted inside the inner diameter of the centrifugal fan that is substantially coextensive with the first conformal zone of the shroud. The restrictor prevents the flow of inlet air through the centrifugal fan in the region of the conformal shroud, thereby preserving substantially the full volume of air available at the air inlet for acceleration in the scroll zone. Also, the restrictor plate has a width which decreases as the distance from the air inlet increases. By means of this design, inlet air gradually flows into the fan as the fan rotates into the second scroll zone of the shroud without starving the fan of inlet air, this provides efficient high volume air from the exit port of the centrifugal fan across a relatively large fan width.

DETAILED DESCRIPTION OF THE DRAWINGS

Figure 1:
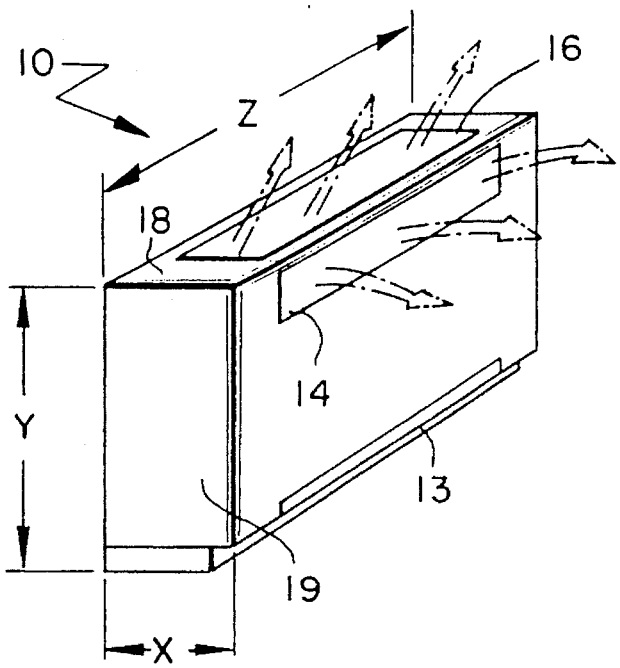
FIG. 1 is a perspective schematic view of a fan coil unit, depicting the air flow therefrom and the nomenclature of the various dimensions.

FIG. 1 depicts a fan coil unit generally at 10. The arrangement of such a fan coil unit is generally shown in U.S. Pat. No. 3,491,550 to Cavis, which is hereby incorporated by reference and which is commonly assigned with the present invention. It should be noted that the invention is preferably implemented with the double width fan of FIG. 10, but is described, for simplicity of description, as applied to a single width fan as shown in FIGS. 1 through 9. A person of ordinary skill in the art will recognize that both width fans are commonly used in the industry.

Fan coil unit 10 has a depth, X, height, Y, and length, Z. Fan coil unit 10 presents a front face 12, side walls 19, and a parallel coextensive back face (shown in FIG. 2) adapted to be mounted flush with the wall of a room to be heated or cooled, in the case of the wall mounted unit. The back face is equally well adapted to be mounted flush with the ceiling of a space to be heated or cooled, in the case of a ceiling mounted fan coil unit 10. Typically, fan coil unit 10 has an air inlet 13 and an air exhaust 14 formed in front face 12 thereof. Additionally, a supplemental air exhaust 16 is formed in top panel 18.

As previously indicated, it is desirable to minimize the dimension of the depth, X. By minimizing depth X, the protrusion of fan coil unit 10 into the space to be heated or cooled is minimized. This is desirable from both aesthetic and space utilization standpoints.

Figure 2A:
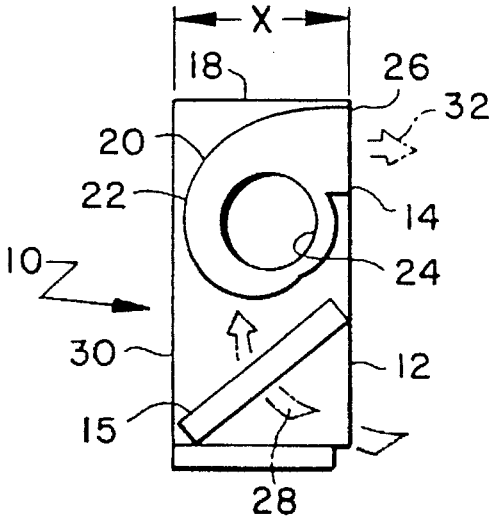
FIGS. 2*a* and 2*b* are schematic views depicting two alternative orientations of a centrifugal fan in accordance with the present invention mounted within fan coil units.

Referring to FIG. 2*a*, a fan 20 in accordance with the present invention and a heat exchanger 15 are depicted mounted within fan coil unit 10. Fan 20 has a housing 22 that is preferably made of sheet metal. The housing 22 defines a first air inlet 24 and a second air inlet 41.

Housing 22 also defines an air exit port 26. Air exit port 26 is typically rectangular in cross section and may be designed to couple with a duct for delivery of air to an air register in the room to be heated or cooled. In the depicted embodiment, air exit port 26 has dimensions compatible with a portion of air exhaust 14. In this configuration, air being expelled from air exit port 26 passes through air exhaust 14 and directly into the room to be cooled or heated.

Prior to entering air inlet 24, and again referring to FIG. 2*a*, air flows upward within the fan coil unit 10 as indicated by arrow 28. Air flow into air inlet 24 is confined in a duct formed by front face 12, rear face 30, and side panel 19 of fan coil unit 10. Air flow passes through the air inlet 13 into the air inlet 24, is conditioned by the heat exchanger 15, is accelerated by the centrifugal fan 20, and is exhausted into the space through air exhaust 14, as indicated by arrow 32.

Figure 2B:
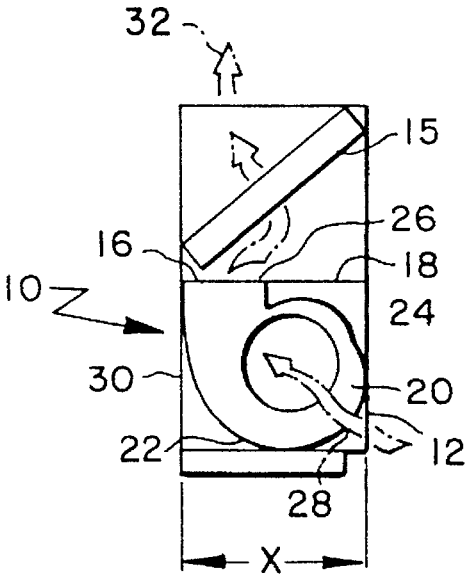

FIG. 2*b* depicts an alternative orientation of fan 20 within fan coil unit 10. The alternative orientation provides for exhaust of heated or cooled air out of supplemental air exhaust 16. In this orientation of fan 20, air enters the air inlet 13 and flows upward in the duct formed by front face 12, rear face 30, and side panels 19 of fan coil unit 10 as indicated by arrow 28. The air enters air inlet 24, is accelerated by the centrifugal fan, and is conditioned by the heat exchanger 15. The accelerated air is exhausted out through the top o fan coil unit 10 via air exhaust 16, as indicated by arrow 32. In this orientation, the housing 22 of fan 20 utilizes the full depth dimension d of fan coil unit 10 that is available.

FIGS. 2*a* and 2*b* also depict the two conventional arrangements of heat exchanger 15 in relation to fan 20. In FIG. 2*a*, a drawthrough arrangement is shown where fan 20 draws air over the heat exchanger 15 inasmuch as the heat exchanger 15 is upstream of the fan 20. FIG. 2*b* shows the preferred arrangement where the fan 20 blows air over the heat exchanger 15 inasmuch as the heat exchanger 15 is downstream of the fan 20.

Figure 4:
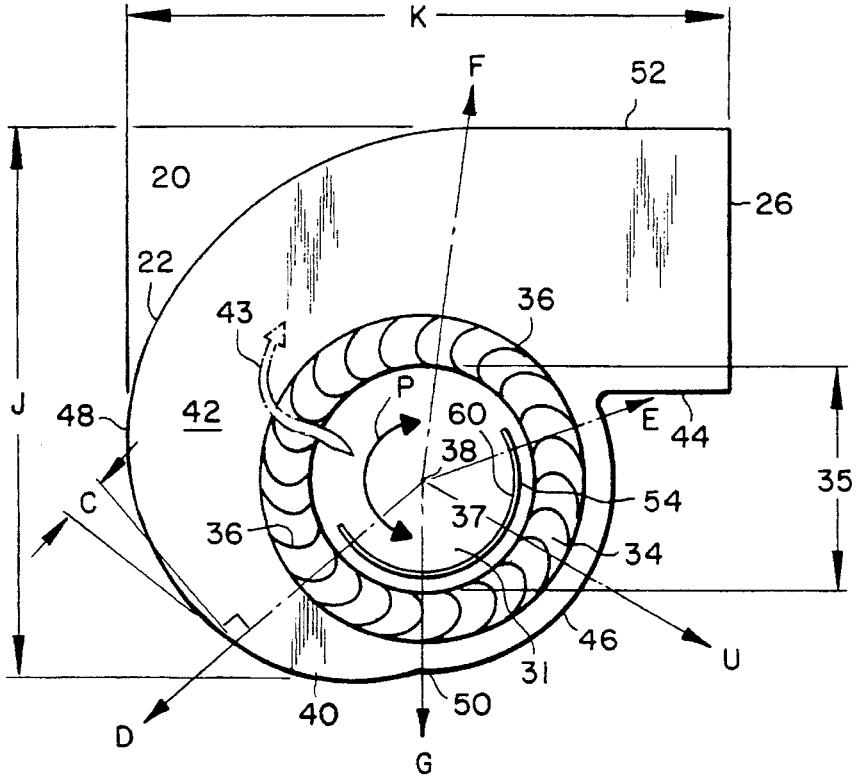
FIG. 4 is a sectional view taken along line 4—4 of FIG. 3 of a centrifugal fan, with the conformal zone of the shroud annotated as between rays E and G and the scroll zone of the shroud annotated as between rays G and F.
Figure 3:
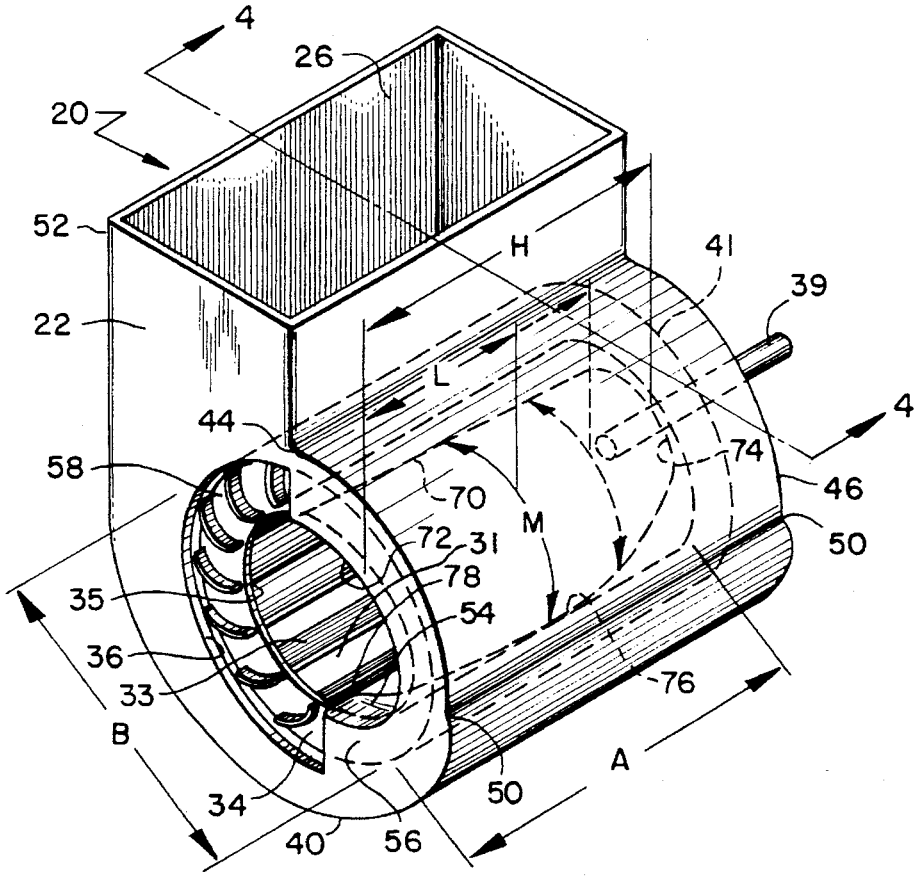
FIG. 3 is a perspective view of a centrifugal fan in accordance with the present invention, with the impeller and the restrictor plate depicted in phantom lines.
Figure 4A:
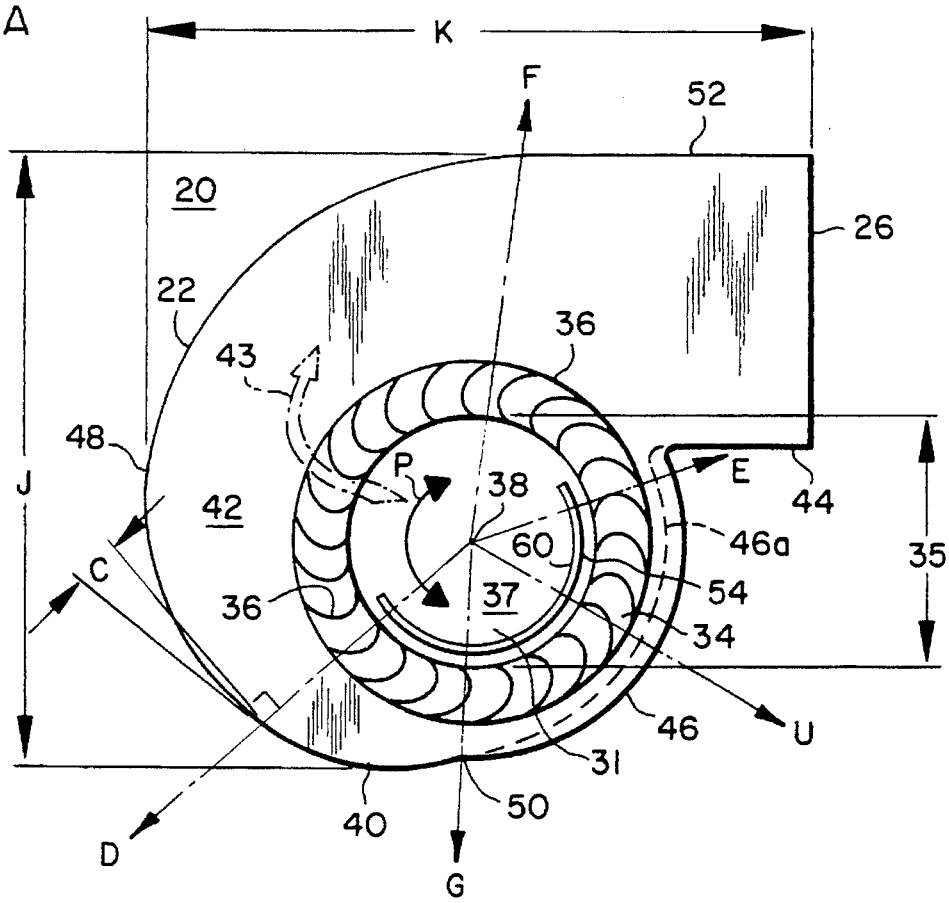
FIG. 4A is a sectional view taken along line 4—4 of FIG. 3, showing an alternative embodiment of FIG. 4.

Referring to FIGS. 3 and 4, fan impeller 34 is mounted within housing 22. Impeller 34 is designed to rotate in a clockwise direction as seen from the perspective of FIG. 3. Impeller 34 has a series of blades 33 that, when rotated, draw air through air inlet 24 to an air chamber 31. Air chamber 31 is defined internal to impeller 34 by the inside diameter 35 of impeller 34. The back side of air chamber 31, that which is opposite air inlet 24, is defined by a metal disc 37. Disc 37 is an integral part of impeller 34 and supports the structure of the blades 33, projecting therefrom. In a non-preferred embodiment, the disk 37 may be perforated or provided with apertures so as o form a second air inlet 41 in the housing 22.

Disc 37 has a central axis 38, about which impeller 34 rotates. Disc 37 is connected to a shaft 39 that is borne in a bearing in housing 22 and by which a motor (not shown) rotationally drives impeller 34. As shown in previously referenced U.S. Pat. No. 3,491,550 to Cavis, the motor (not shown) is preferably positioned between a pair of fans 20, each mounted on the shaft 39. These fans 20 are identical but mirror images. Of course, a single fan or three fans can also be mounted on shaft 39. For ease of explanation, the present invention is discussed in terms of a single fan 20, although two such fans 20 are present in the preferred embodiment. In each of these fans 20, the width of impeller 34 is indicated by the dimension A and the diameter of impeller 33 is indicated by the dimension B.

Housing 22 of fan 20 forms a shroud 40 that in turn defines an air passageway 42 at the periphery of impeller 34. Air passageway 42 commences at the base 44 of air exit port 26 and progresses in a clockwise direction therefrom to ultimately define air exit port 26. This is best viewed with reference to FIG. 4. Air passageway 42 conveys accelerated air from the outside diameter of impeller 34 and expels the air through air exit port 26.

The shroud 40 forms two distinct zones of air passageway 42. The two zones are a first conformal zone 46 and a second scroll zone 48. First conformal zone 46 of air passageway 42 commences at base 44 of air exit port 26 and progresses in a clockwise direction, from the perspective of FIG. 4, for approximately one quarter of a revolution. Conformal zone 46 has a substantially constant radius centered on the central axis defined by axis 38 of impeller 34. The diameter of conformal zone 46, as measured through from the axis 38, is slightly greater than the diameter B of impeller 34, thereby providing an air passageway 42 having a substantially constant radial distance between an outer diameter 36 of impeller 34 and the inner surface of conformal zone 46. The spaced apart design facilitates the free rotation of impeller 34 within the first conformal zone 46 of air passageway 42 defined by shroud 40.

Second scroll zone 48 of air passageway 42 defined by shroud 40 commences at the trailing edge 50 of conformal zone 46. Scroll zone 48 has a scroll zone angle P which wraps around impeller 34 preferably in excess of 180° of rotation, being shown in FIG. 4 as the angle rotating from ray G clockwise to ray F. Scroll zone 48 commences a preferably 6° to 10° expansion angle C with reference to the outside diameter 36 of impeller 34. This expansion angle C is defined as the angle between a tangent to shroud 40 and a line formed at a right angle to ray D, and is illustrated by the angle C depicted in FIG. 4. While an expansion angle between 6° and 10° is preferable, this expansion angle will vary as a function of circumferential location, i.e. the expansion angle C is inversely proportional to the scroll zone angle P. Additionally, while the expansion angle C preferably expands at a linear or constant rate, non-linear and non-constant expansion rates are also contemplated. The commencement of the expansion occurs at the trailing edge 50 of conformal zone 46 and continues to ultimately form the upper lip 52 of air exit port 26. The second scroll zone 48 subtends an arc that partially is dependent on the sizing of the air exit port 26, but is between one quarter and three quarters of a revolution of the impeller 34. Scroll zone 48 defines the expanding portion of air passageway 42 away from the outer diameter 36 of impeller 34.

A restrictor plate 54 is formed integral with housing 22 and comprises an end piece 56 and a plate member 60. An end piece 56 of restrictor plate 54 is positioned generally parallel with, and spaced apart from, inlet end 58 of impeller 34. Preferably, end pieces 56 expand axially relative to axis 38 with non-parallel end pieces 56 such as the linear and nonlinear expansions shown in previously referenced U.S. Pat. No. 3,491,550 to Cavis. For simplicity, the figures show parallel end pieces 56. The inlet end 58 of the impeller 34 is opposite that of the disc 37. The end piece 56 connects and supports plate member 60 of restrictor plate 54 to housing 22. In a preferred embodiment, end piece 56 and inner restrictor plate 54 are formed as a sheet, integral with housing 22, and then later shaped to form end piece 56 and restrictor plate 54.

Plate member 60 of restrictor plate 54 is formed at substantially a right angle to end piece 56. Plate member 60 projects from end piece 56 into the chamber 31 defined within impeller 34 by the inside diameter 35 of impeller 34. As shown in FIG. 4, plate member 60 is curved with a radius that is somewhat less than the radius of inside diameter 35 of impeller 34. Accordingly, plate member 60 is spaced apart inwardly from the inside diameter 35 of impeller 34, thereby permitting the free rotation of impeller 34 between the outer surface of plate member 60 and the inner surface of first conformal zone 46. At its greatest extension, plate member 60 projects into the chamber 31 defined within inside diameter 35 to a point that is proximate, but not touching, disc 37. By remaining spaced slightly apart from disc 37, disc 37 is free to rotate past the furthest extension of plate member 60. The portion of plate member 60 that comprises the furthest extension into the chamber 31 covers an arc that is substantially co-extensive with the arc that is defined by first conformal zone 46 of shroud 40.

Figure 5:
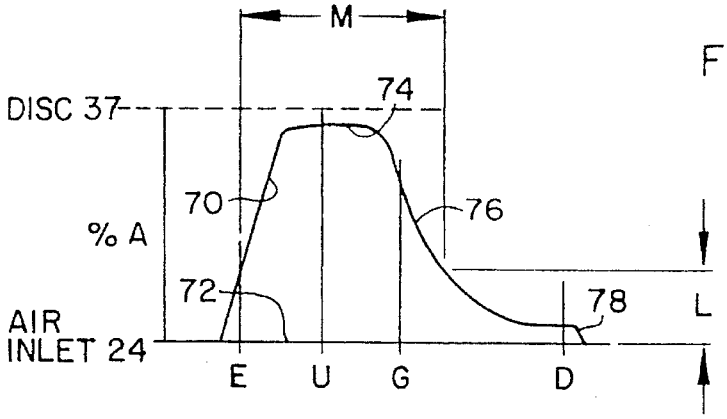
FIG. 5 shows the plan form shape of the restrictor plate and its relationship to the rays E, G, and D as depicted in FIG. 4.

Although the plate member 60 can be formed as a simple rectangle, the plate member 60 is not so formed in the preferred embodiment shown in FIG. 3. Instead, as is best shown in FIGS. 3 and 5, the plate member 60 has a first edge 70 which decreases a distance M between the first edge 70 and a fourth edge 76. This decrease in distance M occurs at a relatively constant rate relative to the end piece 56. That plate member 60 also has a second edge 72 representing the line joining the end piece 56 and the restrictor plate 54, and a third edge 74 substantially parallel to the second edge 72 but shorter in length. The second and third edges 72, 74 are joined on one side of the plate member 60 by the first edge 70. The fourth edge 76 joins the second and third edges 72, 74 on a remaining side of the plate member 60.

The fourth edge 76 has an initial portion 78 which decreases at a rate similar to chat of the first edge 70, but the fourth edge 76 quickly begins to decrease the distance M at an exponential or non-linear rate. This causes the distance M between the first edge 70 and the fourth edge 76 diminish at an increasing rate as the distance L between the particular location of the distance M and the end piece 56 increases. However, a person of ordinary skill in the art will recognize that the first and fourth edges 70, 76 can be modified to: (1) remain at a constant distance M from each other as a distance L from the end piece 56 increases, (2) approach each other at similar rates of approach as the distance L from the end piece 56 increases, or (3) approach each other at dissimilar rates of approach as the distance L from the end piece 56 increases.

Impeller 34 is designed to rotate in a clockwise direction as depicted in FIG. 4. Air, as indicated by arrow 43, is accelerated by the rotating impeller 34 and flows from chamber 31 through blades 34 to air passageway 42. Flow in air passageway 42 is in a clockwise direction, with the accelerated air being expelled at air exit port 26. The two zones of passageway 42 formed by shroud 40 and the position of inner restrictive plate 54 relative to shroud 40 are defined in FIG. 4 by the rays G, D, E and F. The first conformal zone 46 of shroud 40 is depicted between the rays E and G. The expanding second scroll zone 48 of shroud 40 is depicted between the rays G and F. As is readily seen in FIG. 4, first conformal zone 46 has a substantially constant radius as measured from axis 38. The portion of air passageway 42 that defined by first conformal zone 46 maintains a substantially constant distance with respect to outer diameter 36 of impeller 34.

The point where the ray G intersects shroud 40 corresponds to the trailing edge 50 of first conformal zone 46, as depicted in FIG. 4. At this point, shroud 40 transitions from first conformal zone 46 to second scroll zone 48. The 6 to 10 degree expansion that exists in second scroll zone 48 commences at the ray G. This expansion continues through more than 180° of rotation to the point defined by the intersection of the ray F with shroud 40.

Figure 6:
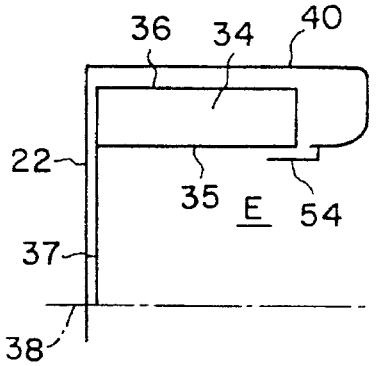
FIG. 6 is a sectional view of the housing and fan taken along the plane defined by the ray E and the hub of the fan between the shroud and the hub.
Figure 7:
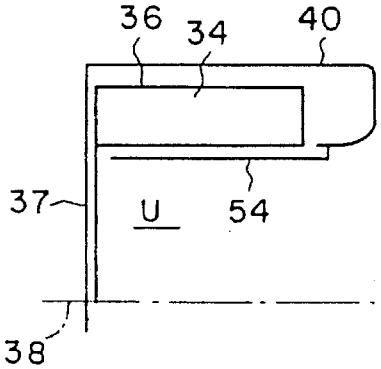
FIG. 7 is a sectional view of the housing and the centrifugal fan taken along a plane defined by Ray U which is located intermediate the rays E and G between the shroud and the hub.

The dimensions of inner restrictor plate 54 are also defined by the rays E, G, and D, as depicted in FIG. 4. Moving in a clockwise direction from base 44 of air exit port 26, restrictor plate 54 commences just prior to ray E. This is depicted in FIGS. 5 and 6. FIG. 5 shows the planform restrictor plate 54 as a function of the various rays E, G, D and the percentage of the width, A, of impeller 34. The width dimension, A, depicted in FIG. 5 is the same dimension A as depicted in FIG. 3. FIG. 6 is a sectional view of fan 20 taken along the ray E (of FIG. 4) from shroud 40 to axis 38. As depicted, restrictor plate 54 is shown overlapping a small portion of inside diameter 35 of impeller 34.

As depicted in FIG. 5, the width H of restrictor plate 54 increases rapidly between rays E and G to a point at which restrictor plate 54 is very nearly in contact with disc 37. This condition is depicted also in FIG. 7, wherein restrictor plate 54 is shown substantially overlapping the entire width A of impeller 34 at the inside diameter 35. This is the condition that exists for substantially the full arc between E and G. It should be noted that the arc between E and G also defines the arc of the first conformal zone 46.

Figure 8:
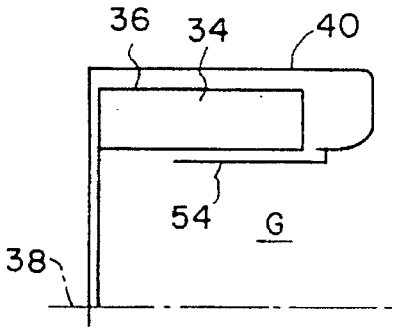
FIG. 8 is a sectional view of the housing and the centrifugal fan taken along a plane defined by G between the shroud and the hub.
Figure 9:
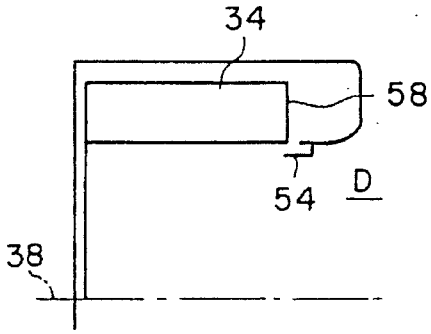
FIG. 9 is a sectional view of the fan housing and the centrifugal fan taken along a plane defined by the angle of ray D between the shroud and the hub.

Ray G is the demarcation between first conformal zone 46 and second scroll zone 48 of shroud 40. The width H of restrictor plate 54 at ray G is already decreasing, as indicated in FIGS. 5 and 8. Between rays G and D, the width H of restrictor plate 54 decreases in a near exponential manner to a point at ray D where restrictor place 54 is positioned very near the inlet end 58 of impeller 34. This condition is depicted in the sectional view of FIG. 9.

Figure 10:
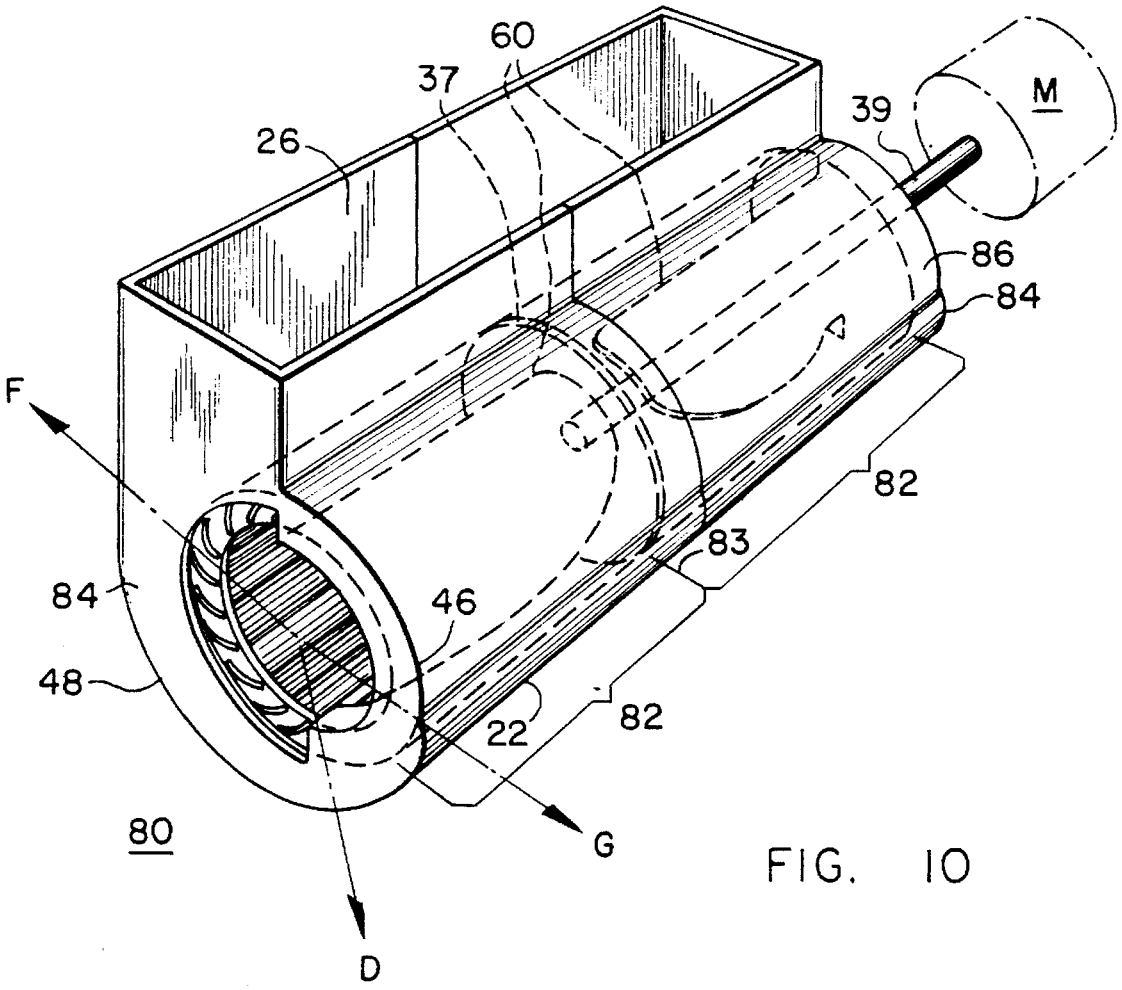
FIG. 10 is a perspective view of a double width centrifugal fan in accordance with the present invention.

FIG. 10 shows a double width fan 80 wherein there are two impeller sections 82, each of A width, and wherein the disc 37 is located centrally 83 relative to the impeller sections 82. The plate members 60, the first conformal zone 46, and the second scroll zone 48 are as described previously. It should be noted that double width fans 80 are typically assembled by inserting the impellers sections 82 into the housing 22 through an open end 84. The housing 22 is then closed off by conventionally attaching a removable end piece 86 which supports the plate member 60 in a manner similar to the fixed end piece 56 described in connection with FIGS. 1 through 9. Once the end piece 86 has been conventionally attached to the housing 22, the disc 37 is attached to the shaft 39.

Operation occurs in both the single and double width fans is as follows:

In operation impeller 34 is rotated in a clockwise direction, from the perspective of FIG. 3, at a desired speed. This action draws air into air inlet 24. Restrictor plate 54 prevents the air from being drawn into impeller 34 in the region of first conformal zone 46. This restricting action preserves the less than free inlet air flow for acceleration by impeller 34 in the second scroll zone 48 of shroud 40. The exponential type decrease in the width of inner restrictor plate 54 that occurs between rays G and D gradually opens the blades 33 of impeller 34 to the flow of inlet air as the impeller 34 rotates through the region defined between rays G and D. By the time that impeller 34 has rotated to the position of ray D, the second scroll zone 48 has expanded considerably and inner restrictor plate 54 has decreased in width H to a point that virtually no restriction is offered to the flow of inlet air to impeller 34.

The inlet air flow to impeller 34 is virtually unrestricted between rays D and E. The air is accelerated by impeller 34 through air passageway 42 and is then expelled from air exit port 26. By utilizing restrictor plate 54 to block the flow of air to impeller 34 through the first conformal zone portion of the rotation of a given blade 34, the full volume of the restricted air flow is preserved for acceleration by the impeller 34 in the second scroll zone portion of rotation. A relatively wide impeller 34 is utilized with a limited volume of air, by restricting flow to impeller 34. The expedient of using the two zone shroud 40 in conjunction with inner restrictor plate 54 permits utilizing an impeller width A that is approximately 120% of the diameter B of the impeller 34 while maintaining the full flow of inlet air through impeller 34 under less than free inlet conditions. Additionally, by utilizing the first conformal zone 46, the total width J of shroud 40 is reduced, thereby facilitating the installation of fan 20 within the confined chamber 31 that is typical of the fan coil unit 10. The dimension "K" is also minimized as the expansion angle increases. Further, by varying the area of restrictor plate 54 in response to the maximum air flow possible at air inlet 24, the performance of fan 20 can be maintained at peak efficiency without having to reduce the width of impeller 34.

The present invention has now been described with reference to several embodiments thereof including both single width and double width fans. It will be apparent to those skilled in the art that many changes can be made in the embodiments described without departing from the scope of the invention. It is particularly important to recognize that the radius of the first conformal zone 46 from the axis 38 and the radius of the plate member 60 from the axis 38 may progressively vary from the impeller 34 as the transition from ray E to ray G takes place. The rate of expansion of the first zone **46*a* being different than the rate of the second zone 48. Additionally, the overlap of the restrictor plate 54 relative to the first conformal zone 46 can be varied to increase, decrease or slightly offset that overlap. Furthermore, the shape of the plate member 60** can be varied both as described and to meet the needs of a particular environment. Thus, the scope of the present invention should not be limited to the structures described herein, but rather by the structures described by the language of the claims, and the equivalents of those structures.

What is claimed is:

1. An improved centrifugal fan having an impeller and a housing, the impeller having an inner diameter and a substantially greater outer diameter and being designed to accelerate air drawn from a central chamber defined within the inner diameter of the impeller to an air passageway defined in the housing substantially surrounding the outer diameter of the impeller, the air passageway terminating in an air exhaust port, the air exhaust port having an inner base that is generally tangential to the outer diameter of the impeller, the housing substantially enclosing the impeller and defining the air exhaust port and an air inlet fluidly coupled to the central chamber defined within the inner diameter of the impeller, the improvement comprising:

a shroud forming a portion of the housing defining the air passageway, the shroud having a first conformal zone being of substantially fixed radius and a second scroll zone being of expanding radius; and a restrictor plate operably coupled to the housing and disposed proximate a portion of the inner diameter of the impeller for restricting the flow of air from the central chamber to the impeller;

wherein the first conformal zone of the shroud has a leading edge and a trailing edge, the leading edge being disposed proximate the base of the air exhaust port;

wherein the restrictor plate has a shape defined by a steeply rising leading edge to an intermediate portion substantially overlapping the entire width of the impeller and a gradually tapering trailing edge; and wherein the restrictor plate is disposed within the central chamber defined within the inner diameter of the impeller such that the intermediate portion subtends an arc that is substantially coextensive with an arc subtended by the first conformal zone of the shroud.

2. A centrifugal fan as claimed in claim 1 wherein the first conformal zone of the shroud subtends an arc of substantially a fourth of a revolution around the impeller.

3. A centrifugal fan as claimed in claim 1 wherein the second scroll zone of the shroud extends through an arc that is substantially more than one quarter and less than three quarters of a revolution around the impeller.

4. A centrifugal fan as claimed in claim 1 wherein the radius of the second scroll zone of the shroud expands at a rate of between five and twelve degrees.

5. A centrifugal fan as claimed in claim 1 wherein the first conformal zone of the shroud has a radius that is greater than the radius of the outside diameter of the impeller such that the first conformal zone of the shroud is spaced apart from the impeller and defines an air passageway therebetween having a substantially constant radial dimension.

6. A centrifugal fan as claimed in claim 1 wherein the second scroll zone of the shroud has a leading edge and a trailing edge, the leading edge of the second scroll zone of the shroud being operably coupled to the trailing edge of the first conformal zone of the shroud and the trailing edge of the second scroll zone of the shroud defining an outer portion of the air exhaust port.

7. A centrifugal fan as claimed in claim 1 wherein the leading edge of the restrictor plate is radially disposed proximate the leading edge of the first conformal zone of the shroud and the gradually tapering trailing edge of the restrictor plate commences the taper from full width radially proximate the trailing edge of the first conformal zone of the shroud.

8. An improved housing for a centrifugal fan, the fan having an impeller defining a central chamber therein from which air is drawn by the impeller, the improvement comprising:

a shroud disposed peripheral to the impeller for defining an air passageway and having a first conformal zone and a second scroll zone; and a restrictor plate disposed within the central chamber and arranged to restrict the flow of air to the impeller;

wherein the restrictor plate has a shape defined by a steeply rising leading ee to an intermediate portion substantially overlapping the entire width of the impeller and a gradually tapering trailing edge;

wherein the restrictor plate is disposed within the central chamber defined within the impeller such that the intermediate portion subtends a first arc that is substantially coextensive with a second arc that is subtended by the first conformal zone of the shroud.

9. A housing as claimed in claim 8 wherein the first conformal zone of the shroud extends substantially a fourth of a revolution around the impeller.

10. A housing as claimed in claim 8 wherein the second scroll zone of the shroud extends through an arc that is substantially more than one quarter and less than three quarters of a revolution around the impeller.

11. A housing as claimed in claim 8 wherein the second scroll zone of the shroud has an expanding radius that expands at a rate of between five and twelve degrees.

12. A housing as claimed in claim 8 wherein the first conformal zone of the shroud has a radius of fixed dimension throughout an arc subtended by the first conformal zone that is greater than the radius of the impeller such that the first conformal zone of the shroud is spaced apart from the impeller and defines an air passageway therebetween having a substantially constant radial dimension.

13. An improved centrifugal fan having an impeller rotatably carried within a housing about an axis, the housing having at least one air inlet and an air discharge port, the fan being designed to be disposed within a relatively confined enclosure, said enclosure restricting the flow of air into the air inlet and defining a reduced space for accommodating the disposition of the fan, the improvement comprising:

a conformal zone of the fan housing having a constant radius relative to the axis of the impeller;

a device restricting the flow of air from the air inlet to the impeller, the device including a leading edge, a trailing edge and an intermediate portion between the leading and trailing edges, the intermediate portion subtending a first arc substantially coextensive with a second arc subtended by the conformal zone and;

a scroll shaped air passageway conveying fan discharge air to the air discharge port, the passageway forming a portion of the fan housing, wherein;

the device restricting the flow of air from the air inlet to the impeller and the scroll shaped air passageway are cooperatively disposed relative to each other and to the impeller such that inlet air is admitted to the impeller and discharge air is conveyed from the impeller through a limited portion of a revolution of the impeller and the device is uniformly curved with a radius that is less than a radius of an inside diameter of the impeller.

14. An improved fan as claimed in claim 13 wherein the scroll shaped air passageway extends through an arc that is substantially more than one quarter and less than three quarters of a revolution around the impeller.

15. An improved fan as claimed in claim 14 wherein the scroll shaped air passageway has an expanding radius that expands at a rate of between five and twelve degrees.

16. An improved centrifugal fan having an impeller and a housing, the impeller having an inner diameter and a substantially greater outer diameter and being designed to accelerate air drawn from a central chamber defined within the inner diameter of the impeller to an air passageway defined in the housing substantially surrounding the outer diameter of the impeller, the air passageway terminating in an air exhaust port, the air exhaust port having an inner base that is generally tangential to the outer diameter of the impeller, the housing substantially enclosing the impeller and defining the air exhaust port and an air inlet fluidly coupled to the central chamber defined within the inner diameter of the impeller, the improvement comprising:

a shroud forming a portion of the housing defining the air passageway and having a first zone a varying radius from a first ray to a second ray and a second zone being of radius expanding at a rate different from the varying radius;

a restriction plate operably coupled to the housing and disposed proximate a portion of the inner diameter of the impeller for restricting the flow of air from the central chamber to the impeller;

wherein the restrictor plate is disposed within the central chamber defined within the inner diameter of the impeller such that the restrictor plate has an intermediate portion which subtends a first arc that is substantially coextensive with an arc subtended by the first zone of the shroud.

17. A restrictor plate comprising:

a surface having a constant radius relative to an axis, the surface including first, second and third edges where the third edge lies in a plane substantially perpendicular to the axis;

said surface being substantially perpendicular to the third edge and each of the first and second edges being located proximate opposite ends of the third edge; and the first and second edges being separated by a first distance which decreases as a second distance from the third edge increases;

wherein the first edge has a rate of change which decreases the first distance at a linear rate, and wherein the second edge has a rate of change which decreases the first distance at a non-linear rate.

* * * * *

UNITED STATES PATENT AND TRADEMARK OFFICE

CERTIFICATE OF CORRECTION

PATENT NO. : 5,570,996

DATED : November 5, 1996

INVENTOR(S) : William A. Smiley III

It is certified that error appears in the above-identified patent and that said Letters Patent is hereby corrected as shown below:

Column 5, Line 49, "o" should read --of--.

Column 6, Line 6, "o" should read --to--.

Column 6, Line 38, delete the word [from].

Column 7, Line 52, "chat" should read --that--.

Column 9, Line 53, after the word "rate" insert --of expansion--.

Claim 8, Column 11, Line 4, "ee" should read --edge--.

Signed and Sealed this

Eighteenth Day of February, 1997

*Attest:*

Bruce Lehman

BRUCE LEHMAN

*Attesting Officer*

*Commissioner of Patents and Trademarks*